US006460622B1

(12) United States Patent
Rice

(10) Patent No.: US 6,460,622 B1
(45) Date of Patent: Oct. 8, 2002

(54) APPARATUS AND SYSTEM CONTROL FOR THE REMOVAL OF FLUIDS AND GAS FROM A WELL

(75) Inventor: Timothy F. Rice, Palm Harbor, FL (US)

(73) Assignee: Global Energy Research, LLC, Tarpon Springs, FL (US)

( * ) Notice: Subject to any disclaimer, the term of this patent is extended or adjusted under 35 U.S.C. 154(b) by 22 days.

(21) Appl. No.: 09/827,446

(22) Filed: Apr. 6, 2001

(51) Int. Cl.[7] ..... E21B 27/00

(52) U.S. Cl. ..... 166/369; 166/53; 417/36; 294/68.22

(58) Field of Search ..... 166/53, 168, 369; 417/2, 36, 904; 294/68.22

(56) References Cited

U.S. PATENT DOCUMENTS

| | | | | |
|---|---|---|---|---|
| 3,044,403 A | | 7/1962 | Ronk | |
| 3,072,193 A | | 1/1963 | Ziegler et al. | |
| 3,424,002 A | * | 1/1969 | Johnson | 73/290 R |
| 3,812,422 A | * | 5/1974 | De Carolis | 324/642 |
| 4,037,662 A | | 7/1977 | Bowling | |
| 4,086,035 A | * | 4/1978 | Klaeger et al. | 166/168 |
| 4,368,909 A | | 1/1983 | Alexander, Jr. | |
| 4,516,911 A | | 5/1985 | Senghaas et al. | |
| 4,583,916 A | * | 4/1986 | Senghaas et al. | 166/168 |
| 4,751,969 A | | 6/1988 | Klaeger | |
| 5,097,901 A | | 3/1992 | Klaeger | |
| 5,251,696 A | | 10/1993 | Boone et al. | |
| 5,314,016 A | | 5/1994 | Dunham | |
| 5,316,085 A | | 5/1994 | Dawson | |
| 5,941,305 A | * | 8/1999 | Thrasher et al. | 166/53 |
| 2002/0046221 A1 | * | 4/2002 | Wallace Louis et al. | 707/513 |

* cited by examiner

*Primary Examiner*—David Bagnell
*Assistant Examiner*—Daniel P Stephenson
(74) *Attorney, Agent, or Firm*—Dennis G. LaPointe; Mason & Associates, P.A.

(57) ABSTRACT

Apparatus and system control for the removal of fluids and gas from a well comprising winch means for removing the oil, a temporary storage tank, a bailer tube, first, second and third bailer tube guide pipes axially aligned to each other, means for exhausting and recovering a natural gas, the bailer tube being capable of being lowered into and elevated from the well casing through the temporary storage tank such that captured oil can be discharged into the temporary storage tank, sensors for monitoring operational parameters including the depth of oil and depth of a top level of water in the well casing, and a programmable logic controller means for providing system control so that only oil is removed from the well casing by using a logging sequence and a balanced oil production operational sequence.

31 Claims, 8 Drawing Sheets

APPARATUS AND SYSTEM CONTROL FOR THE REMOVAL OF FLUIDS AND GAS FROM A WELL

BACKGROUND OF THE INVENTION

1. Field of the Invention

The invention relates to an oil bailer apparatus for use in bailing oil from an oil well as well as removing natural gas.

2. Description of Related Art

Oil bailers are known in the art. However, previous methods of extracting oil, in particular, the bailers and controls used with such bailers fail to differentiate between oil and water in a given well. The problem of non-differentiating between water and oil is especially experienced in low producing wells.

Known related art includes the solid state control system for the oil bailer depicted in U.S. Pat. No. 4,516,911 to Senghaas et al., the oil bailer depicted in U.S. Pat. No. 4,368,909 to Alexander, Jr., and the automated bailer depicted in U.S. Pat. No. 4,037,662 to Bowling.

None of the devices in the above references solve the problem of differentiating between water and oil, especially in low producing wells, and at the same time, address the recovery of natural gas from the oil pumping operation.

It is therefore the intention of this invention to provide an improved oil bailing system, which differentiates between oil and water in a given well, removes only oil, capable of operating on 5,000 foot wells and operates at the removal rate of 25–35 barrels per day. It is also an object of the invention to accomplish the differentiation between water and oil by the incorporation in the system design of a programmable logic control (PLC) to operate the mechanical system portion of the apparatus, and to provide means for accessing data from multiple field sites through a server from a website. This will be used to gather and supply daily data to the manufacture and customer which includes daily output of gas and oil, system error data and daily activities.

It is also an object of the invention to provide a generally 100 percent sealed apparatus so that a vacuum can be applied to recover the natural gas. Most conventional pump jacks and other oil recovery systems use high energy consuming methods and pump out polluted water that must be processed and re-injected back into the oil column, and most allow oil to spill out on to the ground surface. A sealed apparatus will solve these problems.

SUMMARY OF THE INVENTION

The invention which is an apparatus and system control for the removal of fluids and gas from a well includes means for removing fluids from a well bore, the well bore having a well casing therein, and the fluids being substantially oil and water.

The invention further includes a temporary storage tank which has an upper end and a lower end, the lower end being in fluid communication with the well casing. The lower end of the temporary storage tank further includes a first bailer tube guide pipe having means for mechanically coupling the first bailer tube guide pipe at one end to the well casing. The first bailer tube guide pipe sealingly extends into an interior of the temporary storage tank.

The means for mechanically coupling the first bailer tube guide pipe at the one end to the well casing further includes natural gas recovery means for recovering a natural gas exhausting from the well casing.

The first bailer tube guide pipe extends a predetermined height into the interior of the temporary storage tank and has tank valve means for selectively opening and closing an opening of the first bailer tube guide pipe.

The upper end of the temporary storage tank is mechanically coupled to a second bailer tube guide pipe, which sealingly extends a predetermined depth into the interior of the temporary storage tank. The second bailer tube guide pipe has means for mechanically coupling the second bailer tube guide pipe to a third bailer tube guide pipe of predetermined length and axially aligned with the second bailer tube guide pipe. The second and third bailer tube guide pipes are also axially aligned with the first bailer tube guide pipe. Each of the first, second and third bailer tube guide pipes have internal diameters sized to allow a free up and down travel of a bailer tube, also referred to herein as a bailer housing, therein.

Included is pulley means proximate an upper end of the third bailer tube guide pipe over which a cable wire attached to a first end of the bailer tube is run. An opposite end of the cable wire is attached to the means for removing fluids from the well bore, which is typically a driven winch means for pulling the bailer tube out from the well casing and for lowering the bailer tube into the well casing.

A second end of the bailer tube typically has a bailer housing valve, typically a two way direct current (DC) valve, for selectively capturing a column of oil inside the well casing when said bailer tube is lowered therein, and for discharging said captured column of oil into the temporary storage tank when said bailer tube is raised out of the well casing. The bailer housing valve is in electrically operative communication with a programmable logic controller (PLC) means, which is typically an electrical enclosure housing with various processing capabilities which include a microprocessing unit typical of computers, gauges for monitoring various desired operating parameters such as flow rates of oil and gases, oil level in temporary storage tank, pressures, bailer tube travel speeds, etc., actuator switches for activating and controlling the winch and pumping means to empty the temporary storage tank, among other functions. That is, the PLC means is a means for monitoring, operating and controlling the apparatus and for translating readable information to obtain and record operational parameters.

The second end of the bailer tube also includes oil and water sensor means for differentiating between the water and oil inside the well casing as the bailer tube descends therein. The oil and water sensor means defines a top and bottom of a well casing column of oil, as well as the top of water, which essentially coincides with the bottom of the oil column.

The cable wire is preferably a multiple conductor cable wire which is in electrical communication between the bailer housing valve and the driven winch means. The cable wire is also electrically and operatively connected to the PLC means.

The PLC means calculates changes in the size of the oil column, decreasing or increasing the adjustable travel speed of the bailer tube to recover an optimum oil recovery without depleting the oil column. Once correctly positioned at the optimum depth inside the well casing, the bailer housing valve is closed thereby capturing oil inside said bailer tube and the bailer tube is elevated so that bailer housing valve, also referred to herein as bailer valve, is inside and at the upper end of the temporary storage tank at which location, the tank valve means for selectively opening and closing an opening of the first bailer tube guide pipe is closed after which the bailer valve is opened and the captured oil in the bailer tube is discharged into the temporary storage tank.

The tank valve means for selectively opening and closing the opening of the first bailer tube guide pipe, the driven winch means, the oil and water sensor means are also each in electrical and operative communication with the PLC means.

The PLC means controls and monitors a speed of the bailer tube at each location of the bailer tube inside the well casing as the bailer tube is being lowered into and elevated out of the well casing.

In a practical application of the invention, the oil and water sensor means is typically a ground probe switch located at a leading edge of the bailer tube which is activated when a conductive path between a terminal of said ground probe switch is established as the terminal contacts the oil and water under the oil in the well casing thereby defining the top of the oil column, and the bottom of the oil column which also coincides with the top of the water in the well casing.

The driven winch means preferably comprises encoder means in electrical communication with the PLC means for converting a rotation of the winch means into a linear motion to determine a speed of the bailer tube traveling inside the well casing and a location within said well casing. The tank valve means for selectively opening and closing an opening of the first bailer tube guide pipe is a typically a slide gate valve or ball valve.

The temporary storage tank comprises means for monitoring the level of captured oil in the temporary storage tank; and actuation means operatively connected to pumping means for pumping the captured oil from the temporary storage tank to a predetermined storage location.

The means for mechanically coupling the first bailer tube guide pipe to the well casing is preferably a tee-fitting;

although it may be a manifold designed to couple the well casing and the first bailer tube guide pipe. The advantage of a teed fitting or equivalent manifold is to provide an outlet for recovered natural gas and for installing appropriate monitoring devices such as a flow meter and volume gauge as described below.

The natural gas recovery means further comprises means for monitoring one of a flow rate of natural gas exhausting from the well casing, a volumetric quantity of natural gas exhausting from the well casing, and a combination thereof, wherein a corresponding natural gas recovery means data from the means for monitoring one of the flow rate of natural gas exhausting from the well casing, the volumetric quantity of natural gas exhausting from the well casing, and the combination thereof is transmitted to the PLC means.

The means for mechanically coupling the first bailer tube guide pipe to the well casing typically further includes a swivel flange means for aiding in an alignment and installation of the temporary storage tank to the well casing. The means for mechanically coupling the second bailer tube guide pipe to the third bailer tube guide pipe is typically flange means. Gasketed flanges provide excellent mechanical sealing properties in outdoor environmental related industries.

The invention further includes support and guide means at the upper end of the third bailer tube guide pipe for supporting and guiding the wire cable through third bailer tube guide pipe, which is typically a stuffing box and sheave assembly or grease head through which the wire cable is run.

A proximity sensor switch is located proximate the upper end of the third bailer tube guide pipe. The proximity sensor switch is in electrical communication with the PLC means and provides means for decreasing a travel speed of the bailer tube being raised from the well casing. A back up proximity sensor switch is located in a predetermined spaced apart relationship with the proximity sensor switch, typically about 4-8 inches above the primary proximity sensor switch. This back up proximity sensor switch also provides means for decreasing the travel speed of the bailer tube should the proximity sensor switch fail, the back up proximity sensor switch being therefore also in electrical communication with the PLC means.

The PLC means monitors a top of the oil column location within the well casing as well as a bottom location of the oil column within the well casing, the bottom location corresponding to a location of the top of the water column within the well casing.

The optimum depth in the well casing of the second end of the bailer tube for capturing the column of oil without water is an intermediate location, generally half way but any desired location can be selected, between the location of the top of the oil column and above the location of the bottom of the oil column.

In a typical balanced operation sequence the PLC means operationally opens the bailer valve and the tank valve means for selectively opening and closing the opening of the first bailer tube guide pipe, starts the lowering of the bailer tube into the well casing at a predetermine adjustable speed, and increases the adjustable speed to a predetermined adjustable travel speed. The bailer tube is allowed to descend toward the location of the top of the oil column within the well casing, as the adjustable travel speed is decreased at a predetermined location, generally a stored logging depth, above the location of the top of the oil column. The second end of the bailer tube is allowed to enter into the oil column and stop descending at the optimum depth, at which point the bailer valve is closed after a predetermined preset dwell time to capture oil within the bailer tube. The bailer tube then starts elevating through the well casing at an ascending adjustable speed progressing to an ascending adjustable travel speed, slows down as the ascending adjustable travel speed as the bailer tube enters the temporary storage tank. The bailer tube then stops when the second end of the bailer tube is above the tank valve means for selectively opening and closing the opening of the first bailer tube guide pipe at which point the tank valve means for selectively opening and closing the opening of the first bailer tube guide pipe is closed. The bailer valve is then opened for a predetermined top dwell time thereby discharging the captured oil in the bailer tube inside the temporary storage tank, after which dwell time, the two way DC valve is closed after the captured oil has been discharged into the temporary storage tank. The above operational process is then repeated as desired.

The PLC means also activates the actuation means operatively connected to the pumping means for pumping the captured oil from the temporary storage tank when said temporary storage tank accumulates a predetermined level of captured oil.

In a typical logging process or first sequence operation, the PLC means operationally opens the bailer valve and the tank valve means for selectively opening and closing the opening of the first bailer tube guide pipe, starts the lowering of the bailer tube into the well casing at a predetermine adjustable speed, and increases the adjustable speed to a predetermined adjustable travel speed. The bailer tube is then allowed to descend toward the location of the top of the oil column within the well casing. The adjustable travel speed is then decreased at a predetermined location, the pre-set stored logging depth, above the location of the top of the oil column, allowing the second end of the bailer tube to enter into the oil column and stop descending when the oil and water sensor at the second end of the bailer tube is activated. The defined top of the water and bottom of the well casing column of oil location is stored for future use as the control system calculates changes in the size of the oil column, decreasing or increasing the adjustable travel speed of the bailer tube to recover an optimum oil recovery without depleting the oil column. The two way DC valve is then closed after a predetermined preset dwell time to capture oil within the bailer tube. The bailer tube then starts elevating through the well casing at an ascending adjustable speed progressing to an ascending adjustable travel speed. The ascending adjustable travel speed then slows down as the bailer tube enters the temporary storage tank, and the bailer tube stops when the second end of the bailer tube is above the tank valve means for selectively opening and closing the opening of the first bailer tube. The tank valve means for selectively opening and closing the opening of the first bailer tube guide pipe guide pipe closes, the bailer valve opens for a predetermined top dwell time thereby discharging the captured oil in the bailer tube inside the temporary storage tank. The bailer valve then closes after the captured oil has been discharged into the temporary storage tank, and the above logging process is then repeated as desired.

The PLC means is also capable of monitoring an accumulated level of oil in the temporary storage tank, gaseous pressure, oil pressure in the well casing and temporary storage tank using corresponding pressure sensor means. Further, the PLC means may also monitor the hydraulic winch level using a sensor as well as monitor the tension in the cable wire.

In another embodiment of the invention, the PLC means for one or more field sites is operatively connected with one or more Field Communicator PCs, each including a dial up modem, ISDN connector and an FTP router, which in turn communicates with a data base server PC. This server is accessible through a website in which data collection, reporting, analysis and visualization displays can be viewed by a customer base. In addition, each PLC means is operatively in communication with a paging system which outputs data to a field service department.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE INVENTION

Figure 1:
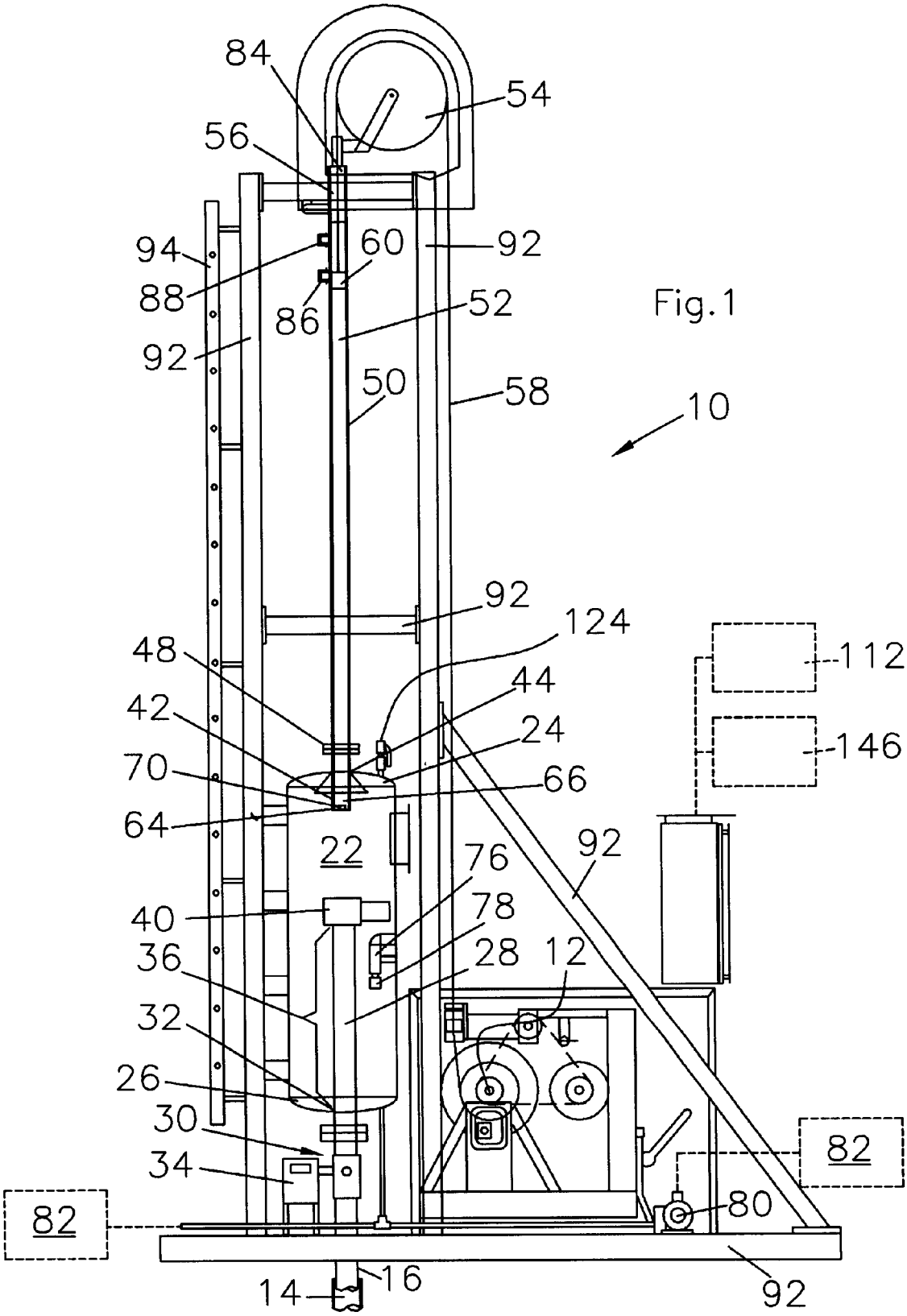
FIG. 1 is a schematic view of the invention.

Referring now to the drawings, in particular FIGS. 1–3 and 4*a*–4*e*, the invention which is an apparatus and system control for the removal of fluids and gas from a well and is depicted generally as 10, includes means 12 for removing fluids from a well bore 14, the well bore 14 having a well casing 16 therein, and the fluids being substantially oil 18 and water 20.

The invention 10 further includes a temporary storage tank 22 which has an upper end 24 and a lower end 26, the lower end 26 being in fluid communication with the well casing 16. The lower end 26 of the temporary storage tank 22 further includes a first bailer tube guide pipe 28 having means 30 for mechanically coupling the first bailer tube guide pipe 28 at one end to the well casing 16. The first bailer tube guide pipe 28 sealingly (as shown at 32 in FIG. 1) extends into an interior of the temporary storage tank 22. The temporary storage tank 22 typically has a capacity of about 20 gallons. The contents of the temporary storage tank 22 can optionally be gravity drained to another location such as a transport truck or other storage location (generically shown in FIG. 1 as 82), the contents may be pumped to a transport tank or other storage location, or the system may have the capability of gravity draining and pumping the contents whichever suits the needs of the field operator.

The means 30 for mechanically coupling the first bailer tube guide pipe 28 at the one end to the well casing 16 further includes natural gas recovery means 34 for recovering a natural gas exhausting from the well casing 16.

The first bailer tube guide pipe 28 extends a predetermined height 36 into the interior of the temporary storage tank 22 and has valve means 40 for selectively opening and closing an opening of the first bailer tube guide pipe 28. The valve means 40 is typically a slide gate valve or ball valve which may be electro-mechanically operated such as a solenoid controlled valve.

The upper end 24 of the temporary storage tank 22 is mechanically coupled to a second bailer tube guide pipe 42, which sealingly (as shown at 44 in FIG. 1) extends a predetermined depth into the interior of the temporary storage tank 22. The penetrations at 32 and 44 into the temporary storage tank 22 to obtain a sealed penetration are usually obtained by welding the first and second bailer tube guide pipes 28,42 through the tank 22 upper and lower respective ends 24,26. The second bailer tube guide pipe 42 has means 48 for mechanically coupling the second bailer tube guide pipe 42 to a third bailer tube guide pipe 50 of predetermined length and axially aligned with the second bailer tube guide pipe 42. The second and third bailer tube guide pipes 42,50 are also axially aligned with the first bailer tube guide pipe 28. Each of the first, second and third bailer tube guide pipes 28,42,50 have internal diameters sized to allow a free up and down travel of a bailer tube 52 therein. Typically, the first, second and third bailer tube guide pipes 28,42,50 are 4 inch pipes while the bailer tube 52 is generally a 3 inch pipe of sufficient length and capable of holding in its interior space approximately 4 gallons of oil.

Included is pulley means 54 proximate an upper end 56 of the third bailer tube guide pipe 50 over which a cable wire 58 attached to a first end 60 of the bailer tube 52 is run. An opposite end 62 of the cable wire 58 is attached to the means 12 for removing fluids from the well bore 14, which is typically a driven winch means 12 for pulling the bailer tube 52 out from the well casing 16 and for lowering the bailer tube 52 into the well casing 16. Consequently, this winch designed cable wire 58 generally comprises a ¼ inch diameter, 4 conductor cable wire in which the well hole end provides the signal to the bailer valve 66 described below to open and close with the sequence of operation.

Figure 4A:
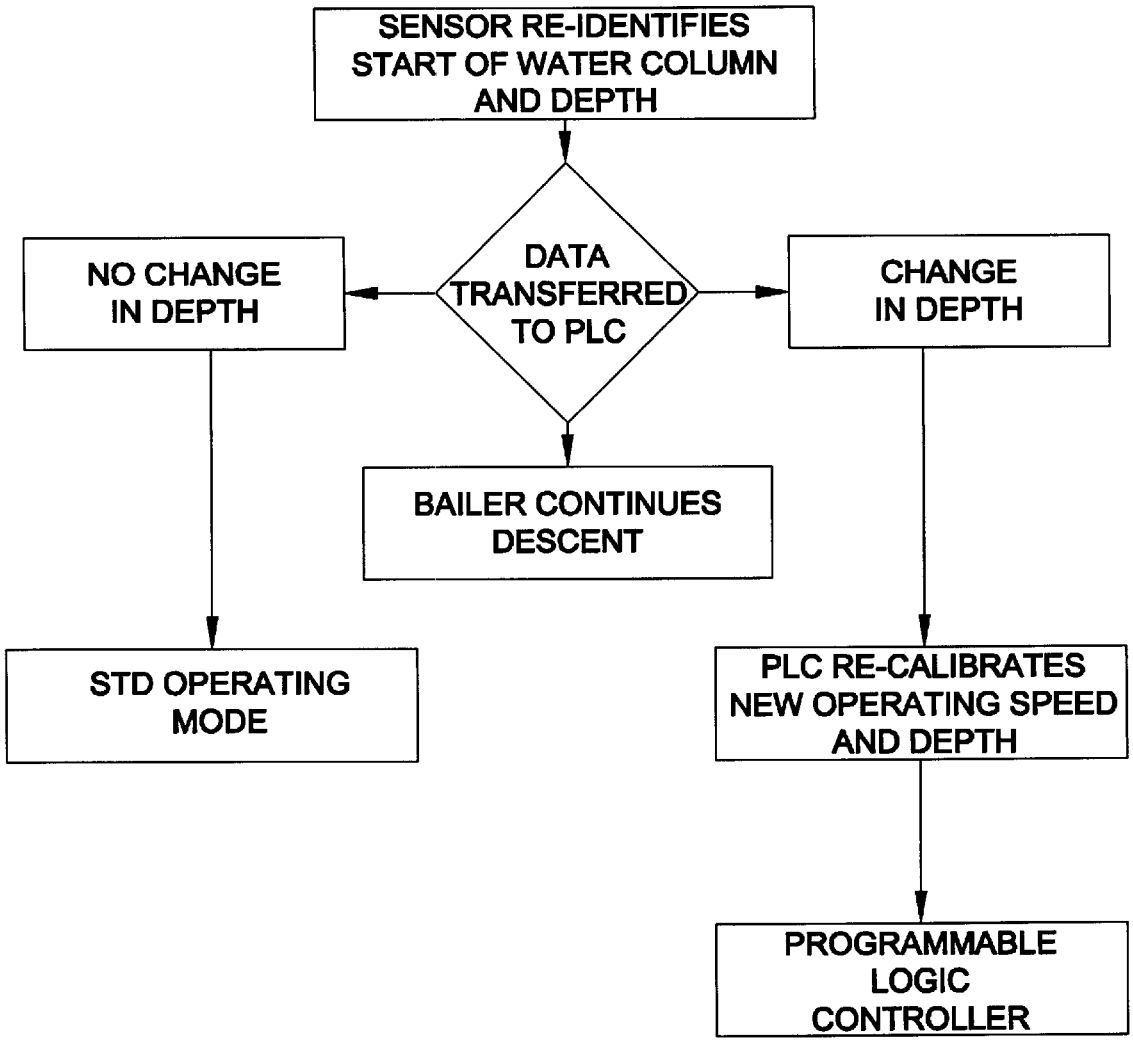
FIG. 4*a* is a diagrammatic flow chart depicting logging process controlled by the PLC means.

A second end 64 of the bailer tube 52 has a bailer valve 66, typically a two way direct current (DC) valve, for selectively capturing a column of oil 68 from inside the well casing 16 when said bailer tube 52 is lowered therein, and for discharging said captured column of oil 68 into the temporary storage tank 22 when said bailer tube 52 is raised out of the well casing 16. The two way DC valve 66, which is typically a 24 volt direct current operated valve, is in electrically operative communication with a Programmable Logic Controller (PLC) means 100. The PLC means 100 is typically an electrical enclosure housing with various processing capabilities which includes an integral microprocessing unit typical of computers, gauges for monitoring various desired operating parameters such as gas and oil flow production rates 112,114, oil level 116 in temporary storage tank 22, pressures such as gas and tank pressures 124,128 bailer tube travel speeds 102 and other operating parameters/characteristics as shown in FIG. 4*d*. Examples of such other parameters may include an oil pump on/off switch 120 for emptying the storage tank 22, a data translator 130, a winch speed indicator 146, bailer location 108, bailer housing valve open position indicator 148*a* and closed position indicator 148*b*, a data output 138, a cycle per minute indicator 122, a cable wire tension sensor indicator 134, a hydraulic winch level sensor 152, a bailer stop switch sensor indicator 86, and a dial up modem 136. The data output 138 may be transmitted using a modem 150. That is, the PLC means 100 is a means for monitoring, operating and controlling the apparatus 10 and for translating readable information or output data 138 to obtain and record operational parameters such as the depth of the bailer tube 104, the location of the bailer tube 108, the flow/volume of gas intake 112, the flow/volume of oil intake 114, the bailer tube cycles per minute 122 and the tension in the cable wire 134, among other operational parameters desired in the field.

Figure 2:
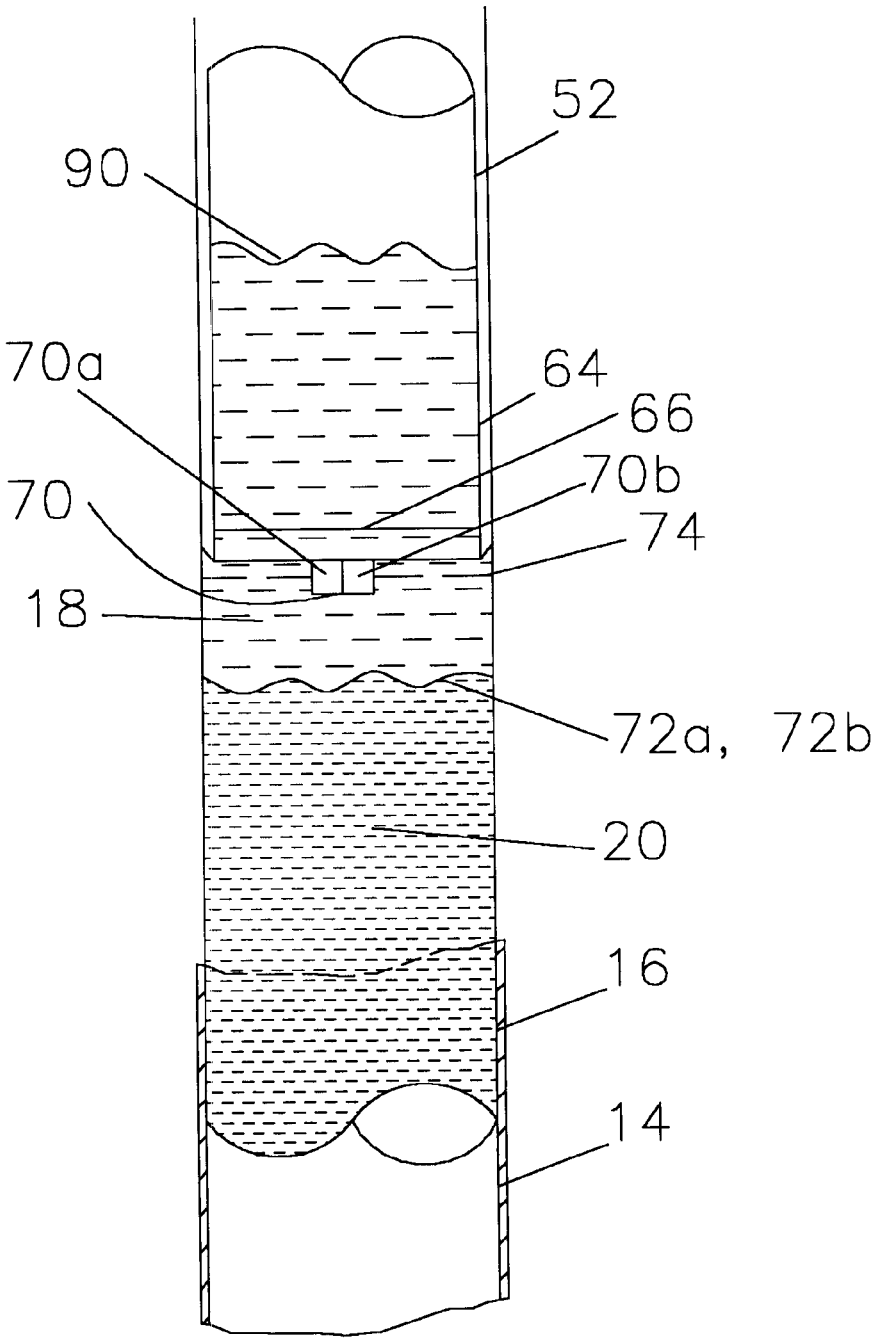
FIG. 2 is a schematic view depicting the end of the bailer tube inside the well casing at an optimum depth.
Figure 3:
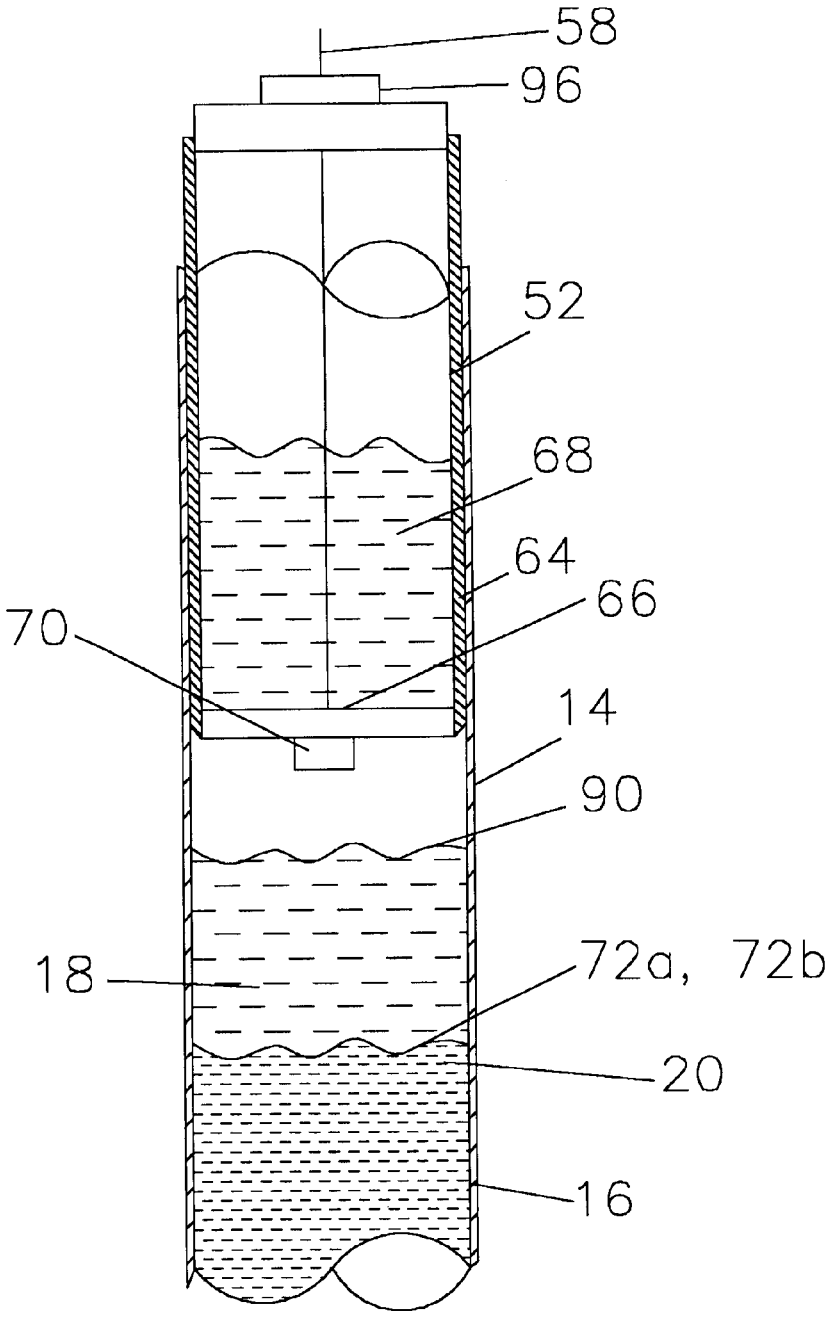
FIG. 3 is a schematic view depicting a captured oil column ascending out of the well casing.

The second end 64 of the bailer tube 52 also includes oil and water sensor means 70, the oil sensor referenced as 70*a* and the water sensor referenced as 70*b* in FIGS. 2 and 4*d*, for differentiating between the water 20 and oil 18 inside the well casing 16 as the bailer tube 52 descends therein. The oil and water sensor means 70 facilitates the defining of a top 72*a* of the water and a bottom 72*b* of a well casing column of oil.

The cable wire 58 is preferably a multiple conductor cable wire which is in electrical communication between the two way DC valve 66 and the driven winch means 12, typically a 10 HP wire winch. The cable wire 58 is also electrically and operatively connected to the PLC means 100. That is, the cable wire 58 transmits all incoming signals through the wire line including information received from the oil and water sensing means 70 to and from the PLC means 100.

The PLC means 100 calculates an optimum depth 74 required for removal of oil 18 without water 20 from the well casing 16 using the oil and water sensing capability 70*a*, 70*b* of the PLC means 100. It does this by continually calculating changes in the size of the oil column, decreasing or increasing the adjustable travel speed of the bailer tube to recover an optimum oil recovery without depleting the oil column. Once correctly positioned at the optimum depth 74 inside the well casing 16, the bailer valve 66 is closed thereby capturing oil 18 inside said bailer tube 52 and the bailer tube 52 is elevated so that the bailer valve 66 is inside and at the upper end 24 of the temporary storage tank 22 at which location, the tank valve means 40 for selectively opening and closing an opening of the first bailer tube guide pipe 28 is closed after which the bailer valve 66 is opened and the captured oil 68 in the bailer tube 52 is discharged into the temporary storage tank 22.

The tank valve means 40 for selectively opening and closing the opening of the first bailer tube guide pipe 28, the driven winch means 12, the oil and water sensor means 70 are also each in electrical and operative communication with the PLC means 100.

The PLC means 100 controls and monitors a speed 102 of the bailer tube 52 at each location 108 of the bailer tube 52 inside the well casing 16 as the bailer tube 52 is being lowered into and elevated out of the well casing 16.

In a practical application of the invention, the oil and water sensor means 70 is typically a ground probe switch located at a leading edge of the bailer tube 52 which is activated when a conductive path between a terminal of said ground probe switch is established as the terminal contacts the water 20 under the oil 18 in the well casing 16 thereby defining the top 72*a* of the water and the bottom 72*b* of the well casing column of oil.

The driven winch means 12 preferably comprises encoder means in electrical communication with the PLC means 100 for converting a rotation of the winch means 12 into a linear motion to determine a speed 102 of the bailer tube 52 traveling inside the well casing 16 and a location 108 within said well casing 16. The tank valve means 40 for selectively opening and closing an opening of the first bailer tube guide pipe 28 is a typically a slide gate valve or ball valve.

The temporary storage tank 22 comprises means for monitoring the level 116 of captured oil 68 in the temporary storage tank 22; and oil pump on/off actuation means 120 operatively connected to pumping means 80 for pumping the captured oil 68 from the temporary storage tank 22 to a predetermined storage location 82. Of course, the temporary storage tank may also be gravity drained under certain circumstances to said predetermined storage location 82.

The means 30 for mechanically coupling the first bailer tube guide pipe 28 to the well casing 16 is typically a tee-fitting or an assembled manifold.

The natural gas recovery means 34 further comprises means for monitoring one of a flow rate of natural gas exhausting from the well casing 16, a volumetric quantity of natural gas exhausting from the well casing 16, and a combination thereof, wherein a corresponding natural gas recovery means data 112 from the means for monitoring one of the flow rate of natural gas exhausting from the well casing, the volumetric quantity of natural gas exhausting from the well casing, and the combination thereof is transmitted to the PLC means 100.

The means 30 for mechanically coupling the first bailer tube guide pipe 28 to the well casing 16 typically further includes a swivel flange means for aiding in an alignment and installation of the temporary storage tank 22 to the well casing 16. The means 48 for mechanically coupling the second bailer tube guide pipe 42 to the third bailer tube guide pipe 50 is typically flange means. Gasketed flanges provide excellent mechanical sealing properties in outdoor environmental related industries.

The invention further includes support and guide means 84 at the upper end 56 of the third bailer tube guide pipe 50 for supporting and guiding the wire cable 58 through third bailer tube guide pipe 50, which is typically a stuffing box and sheave assembly or grease head, through which the wire cable 58 is run.

A proximity sensor switch 86 (bailer stop switch sensor) is located proximate the upper end 56 of the third bailer tube guide pipe 50. The proximity sensor switch 86 is in electrical communication with the PLC means 100 and provides means for stopping the bailer tube 52 being raised from the well casing 16. A back up proximity sensor switch 88 is located in a predetermined spaced apart relationship with the proximity sensor switch 86, typically about 4–8 inches above the primary proximity sensor switch 86. This back up proximity sensor switch 88 also provides means for stopping the bailer tube 52 should the proximity sensor switch 86 fail, the back up proximity sensor switch 88 being therefore also in electrical communication with the PLC means 100.

The PLC means 100 monitors a top 90 of the oil column location within the well casing 16 as well as a bottom location 72*b* of the oil column within the well casing 16, the bottom location 72*b* corresponding to a location of the top 72*a* of the water column 20 within the well casing 16.

The optimum depth 74 in the well casing 16 of the second end 64 of the bailer tube 52 for capturing the column of oil 68 without water 20 is an intermediate location, generally half way but any desired location can be selected, between the location of the top 90 of the oil column and above the location of the bottom 72*b* of the oil column.

Figure 4B:
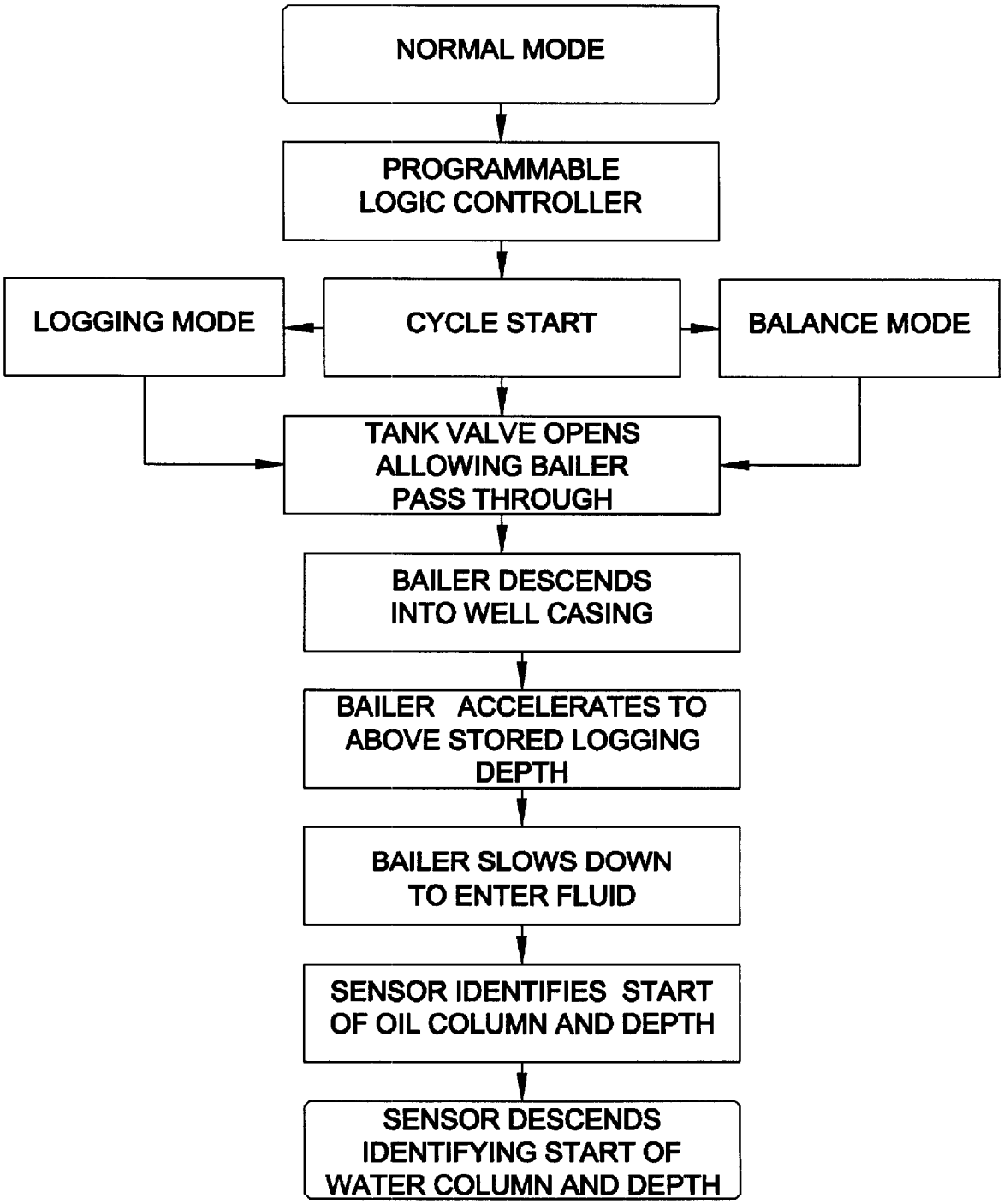
FIG. 4*b* is a diagrammatic flow chart depicting a portion of the normal operational mode of the invention.
Figure 4C:
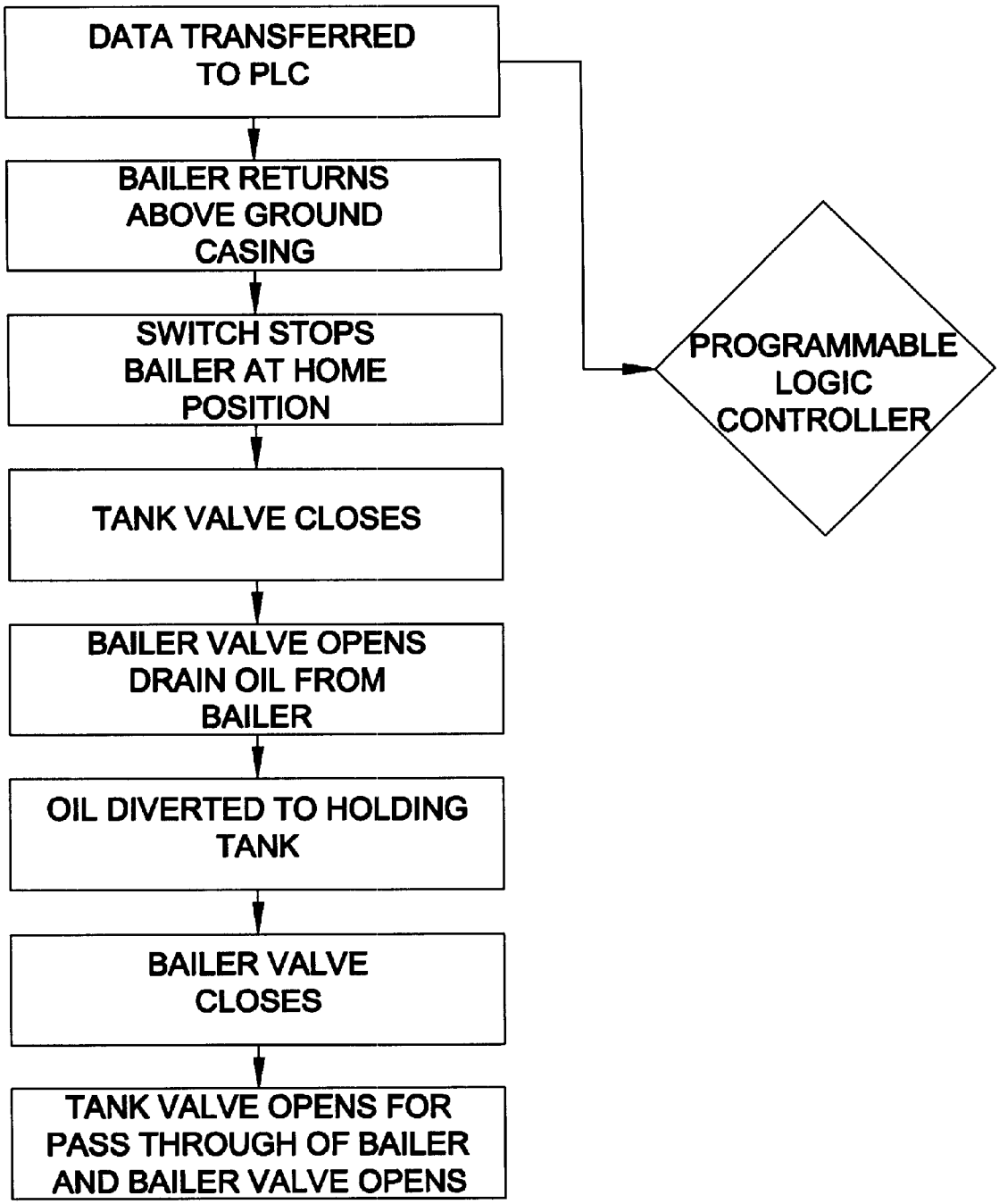
FIG. 4*c* is a diagrammatic flow chart depicting the remaining portion of the normal operational mode started in FIG. 4*b;*
Figure 4D:
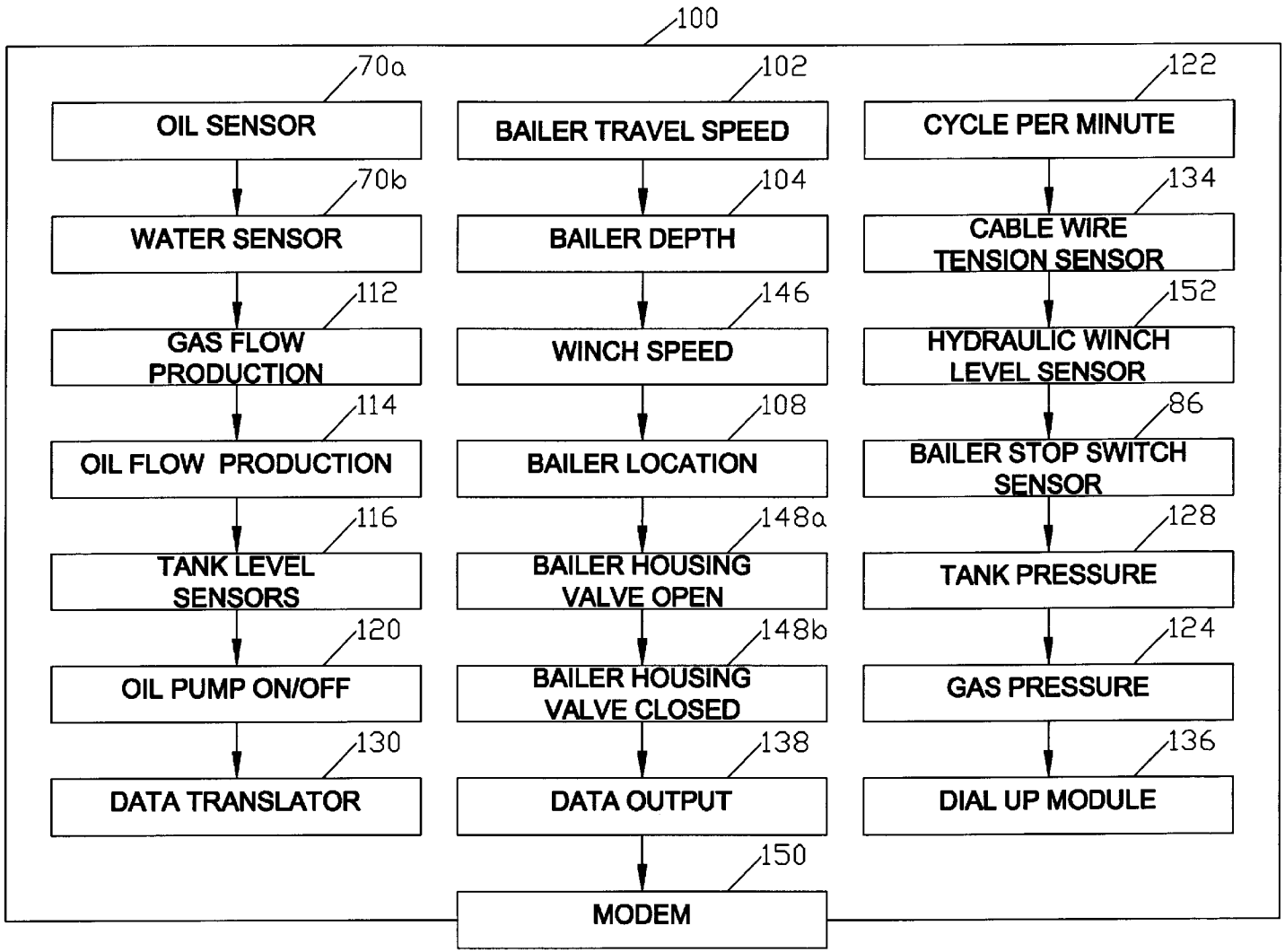
FIG. 4*d* is a diagrammatic flow chart depicting various operational parameters and characteristics monitored and controlled by the PLC.

Referring to FIGS. 4*b* and 4*c*, a typical balanced operation sequence is described in the form of a diagrammatic logic flow chart. In the normal operating mode, the PLC means 100 controls the apparatus 10 such that it runs through both a logging mode and a balance mode, each mode run as needed dependent on the rate of oil replenishment in the well casing 16. The cycling of the apparatus 10 through the logging process is further described below. The cycling of the apparatus 10 through the balance mode follows.

In the balance mode, the PLC means 100 operationally opens the bailer valve 66 and the tank valve means 40 for selectively opening and closing the opening of the first bailer tube guide pipe 28 and starts the lowering of the bailer tube 52 into the well casing 16. The bailer tube 52 accelerates to a predetermined adjustable travel speed 102 until the second end 64 of the bailer tube 52 reaches a predetermined logging depth stored in the PLC means 100, at which time the bailer tube 52 is slowed down to enter the location of the top 90 of the oil column within the well casing 16. Oil sensor 70*a* identifies the start or top 90 of the oil column as well as its depth, transmitting this data through data translator 130 to the PLC means 100. The second end 64 of the bailer tube 52 is allowed to enter into the oil column and stop descending at the optimum depth 74, at which point the bailer valve 66 is closed after a predetermined preset dwell time to capture oil 68 within the bailer tube 52. The bailer tube 52 then starts elevating or returning through the well casing 16 until the first end 60 of the bailer tube 52 activates the proximity sensor or bailer stop switch 86 at its home position. The tank valve means 40 closes and the bailer valve 66 then opens (parameter indicator 148*a* of the PLC means 100) to drain the captured oil 68 from the bailer tube 52 into the temporary storage holding tank 22. The bailer valve 66 then closes (parameter indicator 148*b* of the PLC means 100) and the tank valve means 40 opens for pass through of the bailer tube 52. The bailer valve 66 then opens for eventual capture of oil 68 after completing its descent in the well casing. The above operational process is then repeated as desired until the PLC means 100 requires a logging to re-identify the start or top of water column 72*a* in the well casing.

In the above described balancing process, the normal operating target or depth setting would be the center of the oil column but could be changed if necessary. The PLC means 100 then would automatically calculate this distance and under normal operation, travel down to this point and stop and dwell for a period of time before starting back up the hole.

As mentioned above, the PLC means 100 can be programmed to cycle through the logging sequence mode every so often as well as at the start of operations. Therefore, it will monitor the rate that the oil column 68 is decreasing or increasing and make necessary adjustments to slow down or speed up the normal running sequence. The normal running sequence starts out with the travel speed 102 at optimum operating speed and as the rate the oil column is decreasing, the PLC means 100 compares this rate with the current rate of speed and adjusts the travel speed slightly as needed during the operating cycles. While monitoring the rate of decrease, the PLC means 100 is continuously making small adjustments until the oil column stops decreasing in size maintaining a steady constant size. The PLC means 100 continues to run at this travel speed 102 while continuing to monitor the size of the oil column 68, continuing to make adjustments in order to maintain a balanced sized oil column 68.

The PLC means 100 also activates the actuation means or pump on/off switch 120 which is operatively connected to the pumping means 80 for pumping the captured oil 68 from the temporary storage tank 22 when said temporary storage tank 22 accumulates a predetermined level of captured oil 68. Production for a given well is monitored in the PLC means 100 at 112 and 114.

Well operations will typically start with a logging process mode. Based on experience and geological surveys, the field operators generally have an educated feeling as to the depth at which a top 90 of an oil column so the logging process can be initiated such that the bailer tube 52 is made to accelerate to a pre-set depth above the expected top 90 of the oil column. Of course, if the field operators desire that pre-sent depth may be a couple of hundred feet or more to as little as a few inches below the top of the well casing 16.

Referring more particularly, FIGS. 4*a* and 4*b*, a typical logging process is described as follows. The PLC means 100 operationally opens the bailer valve 66 and the tank valve means 40 for selectively opening and closing the opening of the first bailer tube guide pipe 28, starts the lowering of the bailer tube 52 into the well casing 16 and accelerates to a predetermine adjustable speed 102. The bailer tube 52 is then allowed to descend toward the location of the top 90 of the oil column within the well casing 16. The adjustable travel speed 102 is then decreased at a predetermined location or pre-set stored logging depth above the location of the top 90 of the oil column, allowing the second end 64 of the bailer tube 52 to enter into the oil column 18. Oil sensor 70*a* identifies this depth and transmits the information to the PLC means 100. The water sensor 70*b* then identifies the depth of the start of the water column as the second end 64 of the bailer tube 52 descends to that depth. This depth data or change in depth data as noted in FIG. 4*a* is transmitted to the PLC means 100 which re-calculates and stores a new operating speed 102, stored logging depth, top 90 of oil column depth and top 72*a* or bottom 72*b* of water depth and optimum depth 74. The defined top 72*a* of the water and bottom 72*b* of the well casing column of oil location is stored for future use as the control system 100 calculates the optimum depth 74 of the column of oil 18 in the well casing 16 to remove oil 18 without water 20. The bailer valve 66 is then closed after a predetermined preset dwell time to capture oil 68 within the bailer tube 52. The bailer tube 52 then starts elevating through the well casing 16 and accelerates to an ascending adjustable speed 102, then slows down as the bailer tube 52 enters the temporary storage tank 22 where the bailer tube 52 stops when the second end 64 of the bailer tube 52 is above the valve means 40 for selectively opening and closing the opening of the first bailer tube guide pipe 28. The tank valve means 40 for selectively opening and closing the opening of the first bailer tube guide pipe 28 closes, the bailer valve 66 opens for a predetermined top dwell time thereby discharging the captured oil 68 in the bailer tube 52 inside the temporary storage tank 22.

The bailer valve 66 then closes after the captured oil 68 has been discharged into the temporary storage tank 22, and the above logging process is then repeated as desired until no change is noted and the apparatus 10 resumes its standard balance operating mode.

In short, the logging process or sequence provides the necessary data required for the PLC means 100 to predetermine target settings. As the oil extraction process begins, the weight of the oil column 68 decreases due to the decreasing size of the oil column 68. In addition, the water 20 under the oil column 68 may drive the oil column higher resulting in a change of location of the top 90 of the oil column 68. The PLC means 100 continually monitors the location of the top 90 of the oil column 68 and the depth as well in order to balance the oil column, for this reason the logging process be repeated every so often.

As mentioned above, the PLC means 100 is also capable of monitoring an accumulated level 116 of captured oil 68 in the temporary storage tank 22, gaseous pressure 124, tank pressure 128 using corresponding pressure sensor means, and a tension 134 in the cable wire 58, among other parameters. The PLC means further includes a dial up module and modem for communicating field communicator PC's 160 and paging systems 170 as indicated in the FIG. 4*e* flow chart.

Figure 4E:
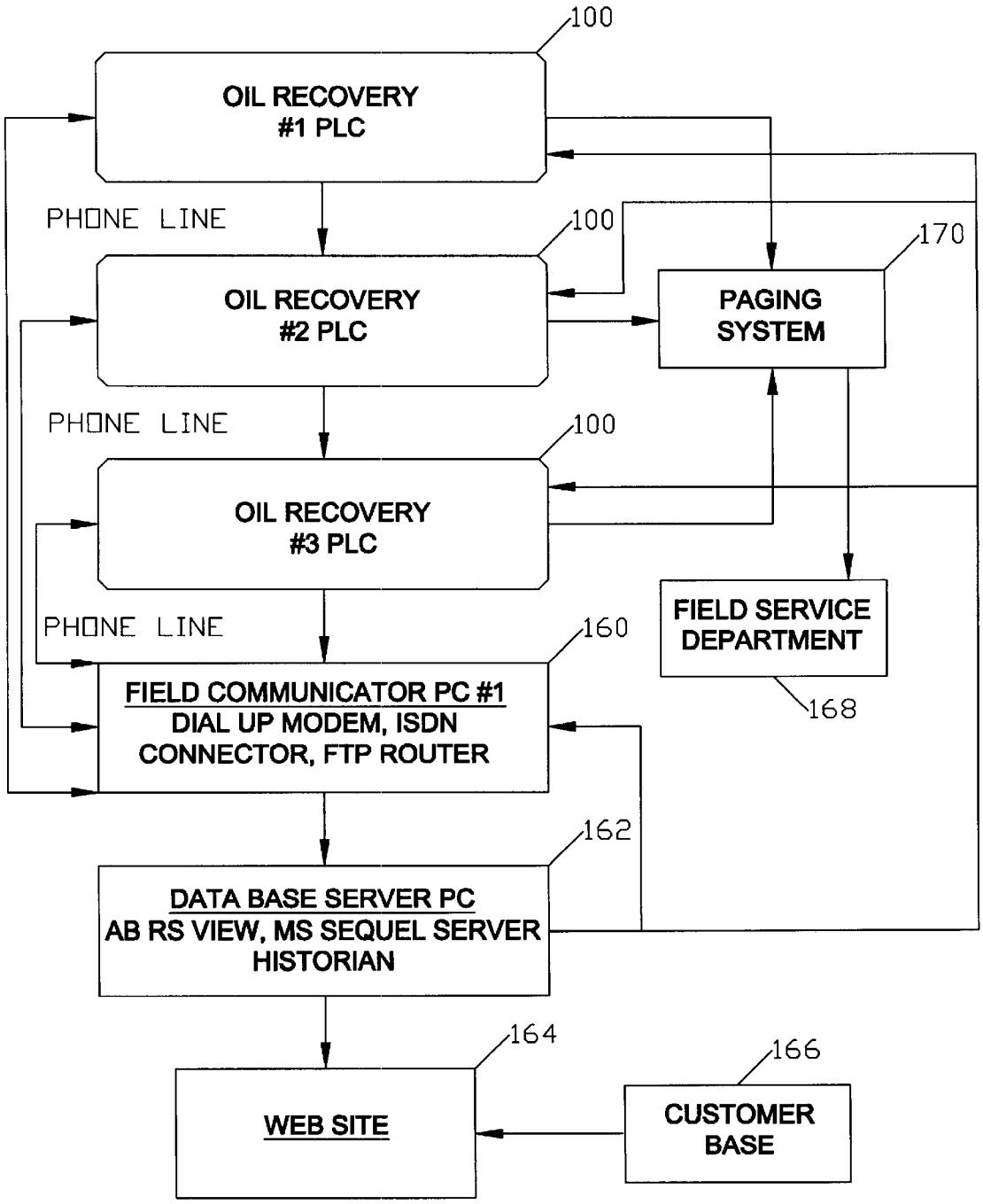
FIG. 4*e* is a diagrammatic chart depicting an embodiment of the invention in which several individual field site PLCs, which are connected through a paging system to a Field Service Department, are also in modem communication with one or more Field Communicator PCs, which in turn route data to a server which can be accessed from a website.

In another embodiment of the invention, multiple apparatus and control systems 10 may be located at various field sites and centrally monitored and controlled. For example, FIG. 4*e* depicts one or more apparatus and control systems at one site or multiple sites, in this case, three oil recovery/PLC units denoted as #1, #2 and #3 respectively, which are in communication with a paging system 170 for communication with a Field Service Department 168 which may be located at or near the sites or remotely some distance away. Field service operators may use this communication means to operationally monitor and control each field installation. Similarly, each apparatus and control systems 10 is in communication a field communicator PC 160 using a dial up modem, an ISDN connector and a FTP router. The field communicator PC transfers data 138 to a data base server PC 162 which may be located at a central data processing site. This server PC 162 typically may utilize an AB RS View software, an Microsoft sequel server data base software and a historian software to analyze, manipulate, store, display data and graphics, among many other functions.

For aid in understanding the interrelationship and capabilities of the invention, the following definitions are provided. The dial up modem is used to go online with a CPU from a remote location to report for down time faults, among other parameters. It typically can provide for up to 244 different paging alarms of pre-set messages. An ISDN connection or Integrated Services Digital Network is set of international communication standards, which are accepted worldwide by communication carriers using a router, that plugs into a phone line jack. ISDN connections can be up to 5 times faster than analog dial up. An FTP (File Transfer Protocol) Router is a device, which allows a specific file or files in a defined location on a hard drive, to be accessed for downloading across the internet. An Allen Bradley RS View software (AB RS) is an example of a custom graphic interface software package, which can directly communicate with a known process, thereby allowing users to change operating parameters. Changes can include feed rate, operating speeds and flow rates, among other parameters. This type of software can also provide machine or equipment history, alarm history, and performs diagnostics. An MS sequel server (PC) is a data base system written by Microsoft for storing, organizing and polling large amounts of data. Other similar systems are known in the art. The historian software is a software package for data collection, reporting, analysis and visualization, including graphics, display. With the integration of these described features, a website 164 may be used to access data from the server 162 by the customer base 166.

For example, apparatus 10 may be installed in one field site location, or multiple apparatus 10 may be installed at or near the same location, or one or more apparatus 10 may be installed at multiple field site locations. Each of these installations, no matter where located, whether it be in a particular state, country or continent, may be connected to a regional field communicator 160 supporting the installations. The server 162 may however be located in a different state, country or continent and accessible from anywhere in the world using the website 164.

The apparatus 10 is generally arranged as diagrammatically depicted in FIG. 1 and structurally supported by a support frame 92 which is built to suit the configuration and may include a ladder 94 to reach the pulley means 54, a base platform, necessary braces, etc.

As seen from the foregoing description, the present invention satisfies a long felt need to provide a device in generally low producing wells which can account for the rate of replenishment of oil in the well bore such that only oil is removed as opposed to the removal of combined oil and water, the latter requiring a much higher production cost to separate the water and to re-inject the water back into the well bore.

The invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in the limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus and system control for the removal of fluids and gas from a well comprising:

means for removing fluids from a well bore, the well bore having a well casing therein, and the fluids being substantially oil and water;

a temporary storage tank having an upper end and a lower end, the lower end being in fluid communication with the well casing;

the lower end of the temporary storage tank further including a first bailer tube guide pipe having means for mechanically coupling the first bailer tube guide pipe at one end to the well casing, the first bailer tube guide pipe sealingly extending into an interior of the temporary storage tank;

the first bailer tube guide pipe extending a predetermine height into the interior of the temporary storage tank and having tank valve means for selectively opening and closing an opening of the first bailer tube guide pipe;

the upper end of the temporary storage tank being in mechanically coupled to a second bailer tube guide pipe, the second bailer tube guide pipe sealingly extending a predetermined depth into the interior of the temporary storage tank, the second bailer tube guide pipe having means for mechanically coupling the second bailer tube guide pipe to a third bailer tube guide pipe of predetermined length and axially aligned with the second bailer tube guide pipe, the second and third bailer tube guide pipes further being axially aligned with the first bailer tube guide pipe, the first, second and third bailer tube guide pipes having internal diameters sized to allow a free up and down travel of a bailer tube therein;

pulley means proximate an upper end of the third bailer tube guide pipe over which a cable wire attached to a first end of the bailer tube is run;

an opposite end of the cable wire being attached to the means for removing fluids from the well bore, the means for removing fluids from the well bore including driven winch means for pulling the bailer tube out from the well casing and for lowering the bailer tube into the well casing;

a second end of the bailer tube having a bailer valve for selectively capturing a column of oil inside the well casing when said bailer tube is lowered therein, and for discharging said captured column of oil into the temporary storage tank when said bailer tube is raised out of the well casing, the bailer valve being in electrically operative communication with a programmable logic controller means;

the programmable logic controller means being means for monitoring, operating and controlling the apparatus and for translating readable information to obtain and record operational parameters;

the second end of the bailer tube further including oil and water sensor means for differentiating between the water and oil inside the well casing as the bailer tube descends therein, wherein the oil and water sensor means defines a top of the water and a bottom of a well casing column of oil;

the cable wire being a multiple conductor cable wire being in electrical communication between the bailer valve and the driven winch means; and the cable wire further being electrically and operatively connected to the programmable logic controller means;

wherein the programmable logic controller means calculates an optimum depth required for removal of oil without water from the well casing and once correctly positioned, the bailer valve is closed thereby capturing oil inside said bailer tube and the bailer tube is elevated so that the bailer valve is inside and at the upper end of the temporary storage tank at which location, the tank valve means for selectively opening and closing an opening of the first bailer tube guide pipe is closed after which the bailer valve is opened and the captured oil in the bailer tube is discharged into the temporary storage tank, wherein the tank valve means for selectively opening and closing the opening of the first bailer tube guide pipe, the driven winch means, the oil and water sensor means are each in electrical and operative communication with the programmable logic controller means, and wherein the programmable logic controller means controls and monitors a speed of the bailer tube at each location of the bailer tube inside the well casing as the bailer tube is being lowered into and elevated out of the well casing.

2. The apparatus and system control for the removal of liquids and gas from a well according to claim 1, wherein the means for mechanically coupling the first bailer tube guide pipe at the one end to the well casing further includes natural gas recovery means for recovering a natural gas exhausting from the well casing.

3. The apparatus and system control for the removal of fluids and gas from a well according to claim 2, wherein the natural gas recovery means further comprises:

means for monitoring one of a flow rate of natural gas exhausting from the well casing, a volumetric quantity of natural gas exhausting from the well casing, and a combination thereof.

4. The apparatus and system control for the removal of fluids and gas from a well according to claim 3, wherein a corresponding natural gas recovery means data from the means for monitoring one of the flow rate of natural gas exhausting from the well casing, the volumetric quantity of natural gas exhausting from the well casing, and the combination thereof is transmitted to the programmable logic controller means.

5. The apparatus and system control for the removal of fluids and gas from a well according to claim 1, wherein the oil and water sensor means is a ground probe switch located at a leading edge of the bailer tube which is activated when a conductive path between a terminal of said ground probe switch is established as the terminal contacts the water under the oil in the well casing thereby defining the top of the water and the bottom of the well casing column of oil.

6. The apparatus and system control for the removal of fluids and gas from a well according to claim 1, wherein the driven winch means further comprises encoder means in electrical communication with the programmable logic controller means for converting a rotation of the winch means into a linear motion to determine a speed of the bailer tube traveling inside the well casing and a location within said well casing.

7. The apparatus and system control for the removal of fluids and gas from a well according to claim 1, wherein the tank valve means for selectively opening and closing an opening of the first bailer tube guide pipe is one of a slide gate valve and a ball valve.

8. The apparatus and system control for the removal of fluids and gas from a well according to claim 1, wherein the temporary storage tank further comprises:

means for monitoring the level of captured oil in the temporary storage tank; and actuation means operatively connected to pumping means for pumping the captured oil from the temporary storage tank to a predetermined storage location.

9. The apparatus and system control for the removal of fluids and gas from a well according to claim 8, wherein the programmable logic controller means activates the actuation means operatively connected to the pumping means for pumping the captured oil from the temporary storage tank when said temporary storage tank accumulates a predetermined level of captured oil.

10. The apparatus and system control for the removal of fluids and gas from a well according to claim 1, wherein the means for mechanically coupling the first bailer tube guide pipe to the well casing is a tee-fitting.

11. The apparatus and system control for the removal of fluids and gas from a well according to claim 1, wherein the means for mechanically coupling the first bailer tube guide pipe to the well casing further comprises:

swivel flange means for aiding in an alignment and installation of the temporary storage tank to the well casing.

12. The apparatus and system control for the removal of fluids and gas from a well according to claim 1, wherein the means for mechanically coupling the second bailer tube guide pipe to the third bailer tube guide pipe further comprises flange means.

13. The apparatus and system control for the removal of fluids and gas from a well according to claim 1, further comprising:

support and guide means at the upper end of the third bailer tube guide pipe for supporting and guiding the wire cable through third bailer tube guide pipe.

14. The apparatus and system control for the removal of fluids and gas from a well according to claim 1, wherein the support and guide means comprises a stuffing box and sheave assembly.

15. The apparatus and system control for the removal of fluids and gas from a well according to claim 1, further comprising a proximity sensor switch located proximate the upper end of the third bailer tube guide pipe, the proximity sensor switch being in electrical communication with the programmable logic controller means and being means for stopping the bailer tube being raised from the well casing.

16. The apparatus and system control for the removal of fluids and gas from a well according to claim 15, further comprising a back up proximity sensor switch located in a predetermined spaced apart relationship with the proximity sensor switch and being means for stopping the bailer tube should the proximity sensor switch fail, the back up proximity sensor switch being in electrical communication with the programmable logic controller means.

17. The apparatus and system control for the removal of fluids and gas from a well according to claim 1, wherein the programmable logic controller means further monitors a top of the oil column location within the well casing as well as a bottom location of the oil column within the well casing, the bottom location corresponding to a location of the top of the water column within the well casing.

18. The apparatus and system control for the removal of fluids and gas from a well according to claim 17, wherein the optimum depth in the well casing of the second end of the bailer tube for capturing the column of oil without water is an intermediate location between the location of the top of the oil column and above the location of the bottom of the oil column.

19. The apparatus and system control for the removal of fluids and gas from a well according to claim 18, wherein the programmable logic controller means performs an operational logging sequence during which the programmable logic controller means operationally opens the bailer valve and the tank valve means for selectively opening and closing the opening of the first bailer tube guide pipe, starts the lowering of the bailer tube into the well casing accelerating to a predetermine adjustable travel speed, allows the bailer tube to descend to a pre-set logging depth above the location of the top of the oil column within the well casing, decreases the adjustable travel speed so that the second end of the bailer tube enters into the oil column at which point the oil sensor means identifies a depth of the top of the oil column, the second end of the bailer tube continues to descend until the water sensor means identifies a depth of the top of the water in the well casing, transmits data reflective of the identification of the depth of the top of the oil and water to the programmable logic controller means which recalculates desired operational parameters including a new logging depth, optimum depth and bailer tube travel speed, closes the bailer valve, starts elevating the bailer tube through the well casing until the bailer tube enters the temporary storage tank, stops the bailer tube when the second end of the bailer tube is above the tank valve means for selectively opening and closing the opening of the first bailer tube guide pipe, closes the tank valve means for selectively opening and closing the opening of the first bailer tube guide pipe, opens the bailer valve for a predetermined top dwell time thereby discharging the captured oil in the bailer tube inside the temporary storage tank, closes the bailer valve after the captured oil has been discharged into the temporary storage tank, and repeats the above operational logging sequence as desired.

20. The apparatus and system control for the removal of fluids and gas from a well according to claim 18, wherein the programmable logic controller means performs a balanced oil production operational sequence during which the programmable logic controller means operationally opens the bailer valve and the tank valve means for selectively opening and closing the opening of the first bailer tube guide pipe, starts the lowering of the bailer tube into the well casing accelerating to a predetermine adjustable travel speed, allows the bailer tube to descend to a pre-set logging depth above the location of the top of the oil column within the well casing, decreases the adjustable travel speed so that the second end of the bailer tube enters into the oil column at which point the oil sensor means identifies a depth of the top of the oil column, the second end of the bailer tube continues to descend into the oil column and stops at the optimum depth at which point the bailer valve is closed after a predetermined preset dwell time to capture oil, transmits data reflective of the identification of the depth of the top of the oil and optimum depth to the programmable logic controller means which continually calculates and monitors desired operational parameters including the logging depth, optimum depth and bailer tube travel speed, starts elevating the bailer tube through the well casing until the first end of the bailer tube enters the temporary storage tank, stops the bailer tube when the second end of the bailer tube is above the tank valve means for selectively opening and closing the opening of the first bailer tube guide pipe, closes the tank valve means for selectively opening and closing the opening of the first bailer tube guide pipe, opens the bailer valve for a predetermined top dwell time thereby discharging the captured oil in the bailer tube inside the temporary storage tank, closes the bailer valve after the captured oil has been discharged into the temporary storage tank, and repeats the above balanced oil production operational sequence as desired.

21. The apparatus and system control for the removal of fluids and gas from a well according to claim 1, wherein the programmable logic controller means further monitors an accumulated level of oil in the temporary storage tank.

22. The apparatus and system control for the removal of fluids and gas from a well according to claim 1, wherein the programmable logic controller means further monitors gaseous pressure.

23. The apparatus and system control for the removal of fluids and gas from a well according to claim 1, wherein the programmable logic controller means further monitors oil pressure in the well casing and temporary storage tank using corresponding pressure sensor means.

24. The apparatus and system control for the removal of fluids and gas from a well according to claim 1, wherein the programmable logic controller means further monitors a tension in the cable wire.

25. The apparatus and system control for the removal of fluids and gas from a well according to claim 1, further comprising a field communicator being operatively in communication with the programmable logic controller means, the field communicator being operatively in communication with a data base server, the data base server for storing, organizing and polling data outputted from the programmable logic controller means, for users to change operating parameters of the programmable logic controller means, for providing historical data and performing diagnostics, and for providing data collection, reporting, analysis and visualization displays.

26. The apparatus and system control for the removal of fluids and gas from a well according to claim 25, wherein the data base server is accessible by a user through a website.

27. The apparatus and system control for the removal of fluids and gas from a well according to claim 1, further comprising a paging system in operative communication with the programmable logic controller means, the paging system for communicating pre-set alarms and messages between a field service department and the programmable logic controller means.

28. A method for the removal of oil and gas without water from a well comprising the steps of:

providing an apparatus and system control for the removal of oil and gas from a well comprising:

means for removing fluids from a well bore, the well bore having a well casing therein, and the fluids being substantially oil and water;

a temporary storage tank having an upper end and a lower end, the lower end being in fluid communication with the well casing;

the lower end of the temporary storage tank further including a first bailer tube guide pipe having means for mechanically coupling the first bailer tube guide pipe at one end to the well casing, the first bailer tube guide pipe sealingly extending into an interior of the temporary storage tank;

the first bailer tube guide pipe extending a predetermine height into the interior of the temporary storage tank and having tank valve means for selectively opening and closing an opening of the first bailer tube guide pipe;

the upper end of the temporary storage tank being in mechanically coupled to a second bailer tube guide pipe, the second bailer tube guide pipe sealingly extending a predetermined depth into the interior of the temporary storage tank, the second bailer tube guide pipe having means for mechanically coupling the second bailer tube guide pipe to a third bailer tube guide pipe of predetermined length and axially aligned with the second bailer tube guide pipe, the second and third bailer tube guide pipes further being axially aligned with the first bailer tube guide pipe, the first, second and third bailer tube guide pipes having internal diameters sized to allow a free up and down travel of a bailer tube therein;

pulley means proximate an upper end of the third bailer tube guide pipe over which a cable wire attached to a first end of the bailer tube is run;

an opposite end of the cable wire being attached to the means for removing fluids from the well bore, the means for removing fluids from the well bore including driven winch means for pulling the bailer tube out from the well casing and for lowering the bailer tube into the well casing;

a second end of the bailer tube having a bailer valve for selectively capturing a column of oil inside the well casing when said bailer tube is lowered therein, and for discharging said captured column of oil into the temporary storage tank when said bailer tube is raised out of the well casing, the bailer valve being in electrically operative communication with a programmable logic controller means;

the programmable logic controller means being means for monitoring, operating and controlling the apparatus and for translating readable information to obtain and record operational parameters;

the second end of the bailer tube further including oil and water sensor means for differentiating between the water and oil inside the well casing as the bailer tube descends therein, wherein the oil and water sensor means defines a top of the water and a bottom of a well casing column of oil;

the cable wire being a multiple conductor cable wire being in electrical communication between the bailer valve and the driven winch means; and the cable wire further being electrically and operatively connected to the programmable logic controller means;

wherein the programmable logic controller means calculates an optimum depth required for removal of oil without water from the well casing and once correctly positioned, the bailer valve is closed thereby capturing oil inside said bailer tube and the bailer tube is elevated so that the bailer valve is inside and at the upper end of the temporary storage tank at which location, the tank valve means for selectively opening and closing an opening of the first bailer tube guide pipe is closed after which the bailer valve is opened and the captured oil in the bailer tube is discharged into the temporary storage tank, wherein the tank valve means for selectively opening and closing the opening of the first bailer tube guide pipe, the driven winch means, the oil and water sensor means are each in electrical and operative communication with the programmable logic controller means, wherein the programmable logic controller means controls and monitors a speed of the bailer tube at each location of the bailer tube inside the well casing as the bailer tube is being lowered into and elevated out of the well casing, wherein the programmable logic controller means further monitors a top of the oil column location within the well casing as well as a bottom location of the oil column within the well casing, the bottom location corresponding to a location of the top of the water column within the well casing, and wherein the optimum depth in the well casing of the second end of the bailer tube for capturing the column of oil without water is an intermediate location between the location of the top of the oil column and above the location of the bottom of the oil column;

conducting a first sequence logging process during which the programmable logic controller means operationally opens the bailer valve and the tank valve means for selectively opening and closing the opening of the first bailer tube guide pipe, starts the lowering of the bailer tube into the well casing accelerating to a predetermine adjustable travel speed, allows the bailer tube to descend to a pre-set logging depth above the location of the top of the oil column within the well casing, decreases the adjustable travel speed so that the second end of the bailer tube enters into the oil column at which point the oil sensor means identifies a depth of the top of the oil column, the second end of the bailer tube continues to descend until the water sensor means identifies a depth of the top of the water in the well casing, transmits data reflective of the identification of the depth of the top of the oil and water to the programmable logic controller means which recalculates desired operational parameters including a new logging depth, optimum depth and bailer tube travel speed, closes the bailer valve, starts elevating the bailer tube through the well casing until the bailer tube enters the temporary storage tank, stops the bailer tube when the second end of the bailer tube is above the tank valve means for selectively opening and closing the opening of the first bailer tube guide pipe, closes the tank valve means for selectively opening and closing the opening of the first bailer tube guide pipe, opens the bailer valve for a predetermined top dwell time thereby discharging the captured oil in the bailer tube inside the temporary storage tank, closes the bailer valve after the captured oil has been discharged into the temporary storage tank, and repeats the above operational logging sequence as desired; and performing a balanced oil production operational sequence during which the programmable logic controller means operationally opens the bailer valve and the tank valve means for selectively opening and closing the opening of the first bailer tube guide pipe, starts the lowering of the bailer tube into the well casing accelerating to the predetermine adjustable travel speed, allows the bailer tube to descend to the pre-set logging depth above the location of the top of the oil column within the well casing, decreases the adjustable travel speed so that the second end of the bailer tube enters into the oil column at which point the oil sensor means identifies the depth of the top of the oil column, the second end of the bailer tube continues to descend into the oil column and stops at the optimum depth at which point the bailer valve is closed after the predetermined preset dwell time to capture oil, transmits the data reflective of the identification of the depth of the top of the oil and optimum depth to the programmable logic controller means which continually calculates and monitors desired operational parameters including the logging depth, optimum depth and bailer tube travel speed, starts elevating the bailer tube through the well casing until the first end of the bailer tube enters the temporary storage tank, stops the bailer tube when the second end of the bailer tube is above the tank valve means for selectively opening and closing the opening of the first bailer tube guide pipe, closes the tank valve means for selectively opening and closing the opening of the first bailer tube guide pipe, opens the bailer valve for a predetermined top dwell time thereby discharging the captured oil in the bailer tube inside the temporary storage tank, closes the bailer valve after the captured oil has been discharged into the temporary storage tank, and repeats the above balanced oil production operational sequence until a change in depth is noted such as to require reinitiation of the logging process.

29. The method according to claim 28, wherein the programmable logic controller means can be programmed to cycle through the first sequence logging process at predetermined time intervals.

30. The method according to claim 29, wherein the programmable logic controller means monitors the rate that the oil column is decreasing or increasing and makes necessary adjustments to slow down or speed up a normal running sequence, wherein the normal running sequence starts out with the travel speed at an optimum operating speed and as a rate of the oil column is decreasing, the programmable logic controller means compares this rate with a current rate of speed of the bailer tube and slows the travel speed of the bailer tube slightly with every cycle, and wherein while monitoring the rate of decrease of the oil column, the programmable logic controller means continuously makes small adjustments until the oil column stops decreasing in size and maintains a steady constant size.

31. The method according to claim 30, wherein the programmable logic controller means continues to run at the travel speed of the bailer tube while continuing to monitor the size of the oil column, and continues to make adjustments in order to maintain a balanced sized oil column.

* * * * *